US006498135B1

(12) United States Patent
Angell et al.

(10) Patent No.: US 6,498,135 B1
(45) Date of Patent: Dec. 24, 2002

(54) PROCESS FOR PRODUCING ELECTROSTATICALLY COATED NON-PARTICULATE DETERGENT PRODUCT

(75) Inventors: Adrian John Waynforth Angell, West Chester, OH (US); Paul Amaat France, West Chester, OH (US); Les Charles Zorb, Loveland, OH (US); Arseniy V. Radomyselskiy, Cincinnati, OH (US)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/601,566

(22) PCT Filed: Apr. 1, 1999

(86) PCT No.: PCT/US99/07313

§ 371 (c)(1),
(2), (4) Date: Aug. 3, 2000

(87) PCT Pub. No.: WO99/51715

PCT Pub. Date: Oct. 14, 1999

Related U.S. Application Data

(60) Provisional application No. 60/080,782, filed on Apr. 6, 1998.

(51) Int. Cl.[7] ..... C11D 11/00; C11D 3/50

(52) U.S. Cl. ..... 510/441; 510/101; 510/294; 510/298; 510/446; 510/447

(58) Field of Search ..... 510/441, 446, 510/447, 294, 298, 101

(56) References Cited

U.S. PATENT DOCUMENTS 5,000,978 A * 3/1991 Davidson et al. ..... 427/27
5,133,892 A * 7/1992 Chun et al. ..... 510/224
5,759,974 A * 6/1998 Menke et al. ..... 510/191

FOREIGN PATENT DOCUMENTS

| | | | | |
|---|---|---|---|---|
| EP | 0405884 | A1 | * | 1/1991 |
| EP | 0711827 | A2 | * | 5/1996 |
| EP | 0816484 | A2 | * | 1/1998 |
| GB | 457975 | | * | 12/1936 |
| WO | Wo 97/29177 | A1 | * | 8/1977 |
| WO | WO 96/35413 | A1 | * | 11/1996 |
| WO | WO 99/27060 | A1 | * | 6/1999 |

* cited by examiner

*Primary Examiner*—Lorna M. Douyon
(74) *Attorney, Agent, or Firm*—C. B. Cook; K. W. Zerby; S. W. Miller

(57) ABSTRACT

A process for producing a non-particulate laundry detergent comprises the steps of providing a powdered porous carrier material, adsorbing a perfume onto the powdered porous carrier material, and depositing the powdered porous carrier material having adsorbed perfume on the non-particulate detergent product. In another aspect of the invention, a process for producing a non-particulate detergent product having a perfume loaded carrier material coating includes the step of providing a non-particulate detergent composition having an electrically conductive surface. The process further includes grounding the electrically conductive surface of the non-particulate detergent composition. Still further, the process includes providing an electrostatically chargeable carrier material having a perfume adsorbed therein. Finally, the process includes coating the electrostatically chargeable carrier material onto the electrically conductive surface of the non-particulate detergent composition by means of an electrostatic charging and delivery system, whereby the electrostatically charged carrier material is adhered to the electrically conductive surface of the detergent composition.

13 Claims, No Drawings

PROCESS FOR PRODUCING ELECTROSTATICALLY COATED NON-PARTICULATE DETERGENT PRODUCT

This application is a 371 of PCT/US 99/07313 filed Apr. 1, 1999, which claims benefit of Provisional Application No. 60/080,782 filed Apr. 6, 1998.

TECHNICAL FIELD

The present invention relates to detergent compositions in non-particulate form. More particularly, the invention relates to a process for improving the aesthetics of detergent compositions in non-particulate form, e.g., tablet, block or bar, by improving the neat product odor of a non-particulate detergent and also enabling the delivery of different fragrances to a non-particulate detergent product as compared to the odor delivered to the laundry by a perfume incorporated within the detergent, by using electrostatic techniques.

BACKGROUND OF THE INVENTION

Non-particulate solids detergents are an alternative to granular or particulate forms of detergents for simplifying the dosing of such detergents for automatic laundry or dishwashing washing machines. Such non-particulate detergents are usually supplied in the form of bars or tablets or briquettes. Such non-particulate detergents not only prevent spillage of the detergent composition but also eliminate the need for the consumer to estimate the correct dosage of the detergent composition per wash. Further, such non-particulate detergents also minimize the contact by the consumer with the detergent.

An important factor for successful performance of a non-particulate detergent is its ability to dissolve in the washing machine in a controlled manner according to a desired dissolution profile during the program cycle of the machine. Another important performance factor is that the non-particulate detergent should be hard enough to facilitate easy handling of the detergent prior to use, so that it does not inadvertently lose its structure, crumble, or deteriorate, both during the packaging, transport and storage and during handling by the end consumer prior to actual use. Such performance aspects are an important feature of the non-particulate detergent, and although they are not necessarily the focus of the present invention, they are inherently a part of the background of the present invention.

A very desirable feature of a non-particulate detergent, such as for example, a tablet, is its appearance and odor. From an aesthetics standpoint, consumers prefer to use detergent tablets that have a fragrant odor. It is thus desirable to improve the neat product odor of detergent tablets. Hence, most detergent compositions include a perfume incorporated within the detergent. However, in order to improve the hardness of the detergent tablet, the tablets are occasionally encapsulated by a protective coating. This coating can substantially mask the odor of the perfume incorporated within the detergent. By dusting the tablet with a perfume carrier, one can improve the neat product odor and make the tablet detergent product more aesthetically pleasing. Additionally, the deposition of a perfume carrier coating on a detergent tablet enables the delivery of different fragrances to the detergent tablet product as compared to the odor delivered to the laundry by a perfume incorporated within the detergent composition.

It is highly desirable to have a laundry detergent tablet with a core which is formed by compressing a particulate material, the particulate material having a surfactant and detergent builder, which is coated with a perfume in order to improve its odor. It is also desirable to provide a laundry tablet with a hard, thin, coating which has a perfume coating deposited on it, so that the laundry tablet has a pleasant odor, it can be stored, shipped and handled, but the coating is broken when the tablet is in the washing machine exposing the soft core which breaks up easily and rapidly, releasing the active ingredients into the wash solution.

Thus, it is highly desirable to improve the neat product odor of a nonparticulate detergent. It is also highly desirable to have a process for providing a non-particulate detergent tablet with a perfume carrier in a manner so that the perfume carrier would adhere to the tablet and remain so during packaging, transport, storage and handling prior to eventual use.

BACKGROUND ART

The prior art is replete with methods of coating tablets, and many methods have been suggested for coating detergent tablets.

GB-A-0 989 683, published on Apr. 22, 1965, discloses a process for preparing a particulate detergent from surfactants and inorganic salts; spraying on water-soluble silicate; and pressing the detergent particles into a solid form-retaining tablet. Finally a readily water-soluble organic film-forming polymer (for example, polyvinyl alcohol) provides a coating to make the detergent tablet resistant to abrasion and accidental breakage.

EP-A-0 002 293, published on Jun. 13, 1979, discloses a tablet coating comprising hydrated salt such as acetate, metaborate, orthophosphate, tartrate, and sulphate.

EP-A-0 716 144, published on Jun. 12, 1996, also discloses laundry detergent tablets with water-soluble coatings which may be organic polymers including acrylic/maleic co-polymer, polyethylene glycol, PVPVA, and sugar.

PCT Publication WO 95/18215, published on Jul. 6, 1995, provides water-insoluble coatings for solid cast tablets. The tablets are provided with hydrophobic coatings including wax, fatty acid, fatty acid amides, and polyethylene glycol.

Other prior art discloses the use of carriers, such as zeolite, for example, for delivering perfume. For example, U.S. Pat. No. 5,648,328 discloses a process for producing a particulate laundry additive composition for perfume delivery primarily in laundry detergent and fabric softening products. The process utilizes a porous carrier material loaded with a perfume and as a result of this process, the perfume is sealed into the carrier material sufficiently to not permit exposure until subjected to the laundering or softening process. In the '328 patent, the preferred perfume carrier materials are zeolite X, zeolite Y, and mixtures thereof However the focus of the '328 patent is on particulate laundry composition additives and not on non-particulate detergents having perfume deposited on the surface.

U.S. Pat. No. 5,000,978 discloses a process for making coated detergent granules by producing detergent granules and then uniformly distributing finely divided powder onto the surfaces of the detergent granules by means of an electrostatic charging and delivery system.

SUMMARY OF THE INVENTION

The invention meets the needs above by providing a process for producing a non-particulate detergent having an improved neat product odor, and a process for producing a non-particulate detergent product having a perfume loaded carrier material coating.

In one aspect of the present invention, the process comprises the steps of (a) providing a powdered porous carrier material; (b) adsorbing a perfume onto the powdered porous carrier material; and (c) depositing the powdered porous carrier material having adsorbed perfume on the non-particulate detergent product. With the aforementioned optimally selected steps of the present invention, a uniform coating of a perfume laden porous carrier material is adhered to a detergent tablet surface, thus improving its neat product odor and also enabling the delivery of different fragrances to the detergent tablet product as compared to the odor delivered to the laundry by a perfume incorporated within the detergent composition.

In another aspect of the present invention, the process includes the step of providing a non-particulate detergent composition having an electrically conductive surface. The process further includes the step of grounding the electrically conductive surface of the non-particulate detergent composition. Still further, the process includes the step of providing an electrostatically chargeable carrier material having a perfume adsorbed therein. Finally, the process includes the step of coating the electrostatically chargeable carrier material onto the electrically conductive surface of the non-particulate detergent composition by means of applying an electrostatic charge with an electrostatic charging and delivery system, such that the electrostatically charged carrier material is adhered to the electrically conductive surface of the detergent composition, even after the electrostatic charge has dissipated.

DETAILED DESCRIPTION OF THE INVENTION

As used herein, the phrase "electrically conductive" means that the surface is capable of allowing electric current to pass through it without offering a substantial resistance to the flow of current.

As used herein, the phrase "electrostatically chargeable" means a powder that is ionically chargeable by electrostatic induction means.

Process

The process of the invention unexpectedly provides a means by which a non-particulate detergent composition, say, a tablet, can be coated with a finely sized uniformly dispersed, thin layer coating of a perfume loaded powder, thus improving its neat product odor and also enabling the delivery of different fragrances to the detergent tablet product as compared to the odor delivered to the laundry by a perfume incorporated within the detergent composition.

Different modes of deposition can be chosen, such as spraying, dusting, using a fluidized bed chamber and the like. Most unexpectedly, it has been discovered that the amount of the perfume loaded powder deposited electrostatically in a fixed amount of time according to the claimed process invention, is more than ten times greater than the amount of perfume loaded powder depositable without following the steps of the claimed process invention. Further, this process unexpectedly produces an extremely uniform coating of a de-agglomerated perfume loaded powder, which enhances the aesthetics of the detergent tablet, such as appearance and smell.

In one embodiment, the porous carrier particles loaded with perfume can be electrostatically deposited on the surface of the detergent tablet without treating the detergent tablet surface. In another embodiment, the detergent tablet surface can be electrostatically charged or connected to a grounding source. Preferably, a detergent tablet having an electrically conductive surface formed of a coating, as described hereinafter, is provided. The detergent tablet having the electrically conductive coating, is electrically connected to a grounding source. A porous carrier material having perfume adsorbed therein, as described hereinafter, is also provided. The porous carrier material selected must be electrostatically chargeable. The porous carrier material is electrostatically charged and delivered to the grounded detergent tablet by one of various electrostatic charging and delivery systems, such as by using an electrostatic powder spray gun or an electrostatic fluidized bed coater, as described in more detail in the ensuing paragraphs. The charged perfume loaded carrier powder is distributed onto the surface of the grounded detergent tablet. The carrier powder and the detergent tablet surface are attracted to each other due to Coulomb forces and a uniform coating of the perfume loaded carrier material on the detergent tablet surface is resultantly formed. Because the carrier powder de-agglomerates upon electrostatic charging, a superior, more uniform coverage of the tablets is obtained and the coating remains adhered to the detergent tablet even after the electrostatic charge has dissipated.

Non-particulate Detergent Composition

The detergent tablets to be coated with a perfume can be prepared simply by mixing the solid ingredients together and compressing the mixture in a conventional tablet press as used, for example, in the pharmaceutical industry. Any liquid ingredients, for example the surfactant or suds suppresser, can be incorporated in a conventional manner into the solid particulate ingredients. Preferably, the principal ingredients are used in a particulate form.

In particular for laundry tablets, the ingredients such as builder and surfactant can be spray-dried in a conventional manner and then compacted at a suitable pressure.

The detergent tablets provided can be made in any size or shape and can, if desired, be surface treated before providing a perfume coating, according to the present invention. In the core of the tablet is included a surfactant and a builder which normally provides a substantial part of the cleaning power of the tablet. The term "builder" is intended to mean all materials which tend to remove calcium ion from solution, either by ion exchange, complexation, sequestration or precipitation.

The particulate material used for making the detergent tablet provided in this invention can be made by any particulation or granulation process. An example of such a process is spray drying (in a co-current or counter current spray drying tower) which typically gives low bulk densities 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallization sentering, etc. The individual particles can also be in any other form, such as for example, particle, granule, sphere or grain.

The particulate materials may be mixed together by any conventional means, for example, a concrete mixer, Nauta mixer, ribbon mixer or any other. Alternatively the mixing process may be carried out continuously by metering each component by weight on to a moving belt, and blending them in one or more drum(s) or mixer(s). A liquid spray-on to the mix of particulate materials (e.g. non-ionic surfactants) may be carried out. Other liquid ingredients may also be sprayed on to the mix of particulate materials either separately or premixed. For example perfume and slurries of optical brighteners may be sprayed. A finely divided flow aid (dusting agent such as zeolites, carbonates, silicas) can be added to the particulate materials after spraying the non-ionic, preferably towards the end of the process, to make the mix less sticky.

The detergent tablets provided may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). In one embodiment, the tablets are coated with an electrically conductive coating in order to provide an electrically conductive surface for the detergent tablet. The tablets are coated with a coating that is both electrically conductive and substantially insoluble in water so that the tablet does not absorb moisture, or absorbs moisture at only a very slow rate. The coating is also strong so that moderate mechanical shocks to which the tablets are subjected during handling, packing and shipping result in no more than very low levels of breakage or attrition. Further, the coating is preferably brittle so that the tablet breaks up when subjected to stronger mechanical shock. Furthermore it is advantageous if the coating material is dissolved under alkaline conditions, or is readily emulsified by surfactants. This avoids the deposition of undissolved particles or lumps of coating material on the laundry load. This may be important when the coating material is completely insoluble (for example less than 1 g/l) in water.

As defined herein "substantially insoluble" means having a very low solubility in water. This should be understood to mean having a solubility in water at 25° C. of less than 20 g/L, preferably less than 5 g/l, and more preferably less than 1 g/l. Water solubility is measured following the test protocol of ASTM E1148-87 entitled, "Standard Test Method for Measurements of Aqueous Solubility".

Suitable coating materials are fatty acids, adipic acid and $C_8$–$C_{13}$ dicarboxylic acids, fatty alcohols, diols, esters and ethers. Preferred fatty acids are those having a carbon chain length of from $C_{12}$ to $C_{22}$ and most preferably from $C_{18}$ to $C_{22}$. Preferred dicarboxylic acids are adipic acid ($C_6$), suberic acid ($C_8$), azelaic acid ($C_9$), sebacic acid ($C_{10}$), undecanedioic acid ($C_{11}$), dodecanedioic acid ($C_{12}$) and tridecanedioic acid ($C_{13}$). Preferred fatty alcohols are those having a carbon chain length of from $C_{12}$ to $C_{22}$ and most preferably from $C_{14}$ to $C_{18}$. Preferred diols are 1,2-octadecanediol and 1,2-hexadecanediol. Preferred esters are tristearin, tripalmitin, methylbehenate, ethylstearate. Preferred ethers are diethyleneglycol mono hexadecylether, diethyleneglycol mono octadecylether, diethyleneglycol mono tetradecylether, phenylether, ethyl naphtyl ether, 2 methoxynaphtalene, beta naphtyl methyl ether and glycerol monooctadecylether. Other preferred coating materials include dimethyl 2,2 propanol, 2 hexadecanol, 2 octadecanone, 2 hexadecanone, 2, 15 hexadecanedione and 2 hydroxybenzyl alcohol. The electrically conductive coating is a hydrophobic material having a melting point preferably of from 40° C. to 180° C.

In the preferred embodiment, the electrically conductive coating can be applied in a number of ways. Two preferred coating methods are a) coating with a molten material and b) coating with a solution of the material. In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below 40° C. are not sufficiently solid at ambient temperatures and it has been found that materials having a melting point above about 180° C. are not practicable to use. Preferably, the materials melt in the range from 60° C. to 160° C., more preferably from 70° C. to 120° C.

By "melting point" is meant the temperature at which the material when heated slowly in, for example, a capillary tube becomes a clear liquid.

An electrically conductive coating of any desired thickness can be applied according to the present invention. For most purposes, the electrically conductive coating forms from 1% to 10%, preferably from 1.5% to 5%, of the tablet weight.

Alternatively, the detergent tablet may be imparted with an electrically conductive surface without providing a coating. One method of providing an electrically conductive surface is by providing an electrostatic charge on the surface of the detergent tablet.

Porous Carrier Particles

As used herein, "porous carrier particles" means any material capable of supporting (e.g., by absorption onto the surface or adsorption into pores) a perfume agent for incorporation into the particulate compositions. Such materials include porous solids selected from the group consisting of amorphous silicates, crystalline nonlayer silicates, layer silicates, calcium carbonates, calcium/sodium carbonate double salts, sodium carbonates, clays, zeolites, sodalites, alkali metal phosphates, macroporous zeolites, chitin microbeads, carboxyalkylcelluloses, carboxyalkylstarches, cyclodextrins, porous starches and mixtures thereof Preferred perfume carrier materials are zeolite A, zeolite X, zeolite Y, zeolite P, zeolite MAP and mixtures thereof. The term "zeolite" used herein refers to a crystalline aluminosilicate material. The structural formula of a zeolite is based on the crystal unit cell, the smallest unit of structure represented by $$Mm/n[(AlO_2)m(SiO_2)y].xH_2O$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium.

Adsorption of Perfume on Zeolite

The zeolites to be used herein preferably contain less than about 20% desorbable water, more preferably less than about 8% desorbable water, and most preferably less than about 5% desorbable water. Such materials may be obtained by first activating/dehydrating by heating to about 150° C. to 350° C., optionally with reduced pressure (from about 0.001 to about 20 Torr). After activation, the perfume is slowly and thoroughly mixed with the activated zeolite and, optionally, heated to about 60° C. for up to about 2 hours to accelerate absorption equilibrium within the zeolite particles. The perfume/zeolite mixture is then cooled to room temperature and is in the form of a free-flowing powder.

In the preferred embodiment, the perfume is adsorbed on the surface of the zeolite by spraying liquid perfume on the zeolite particles. It is preferred to adsorb the perfume on the surface of the zeolite rather than incorporating the perfume within the zeolite because the odor of the perfume that is adsorbed on the zeolite rather than incorporated therein is greater, when the perfume laden zeolite powder is electrostatically coated on the detergent tablet surface.

In the preferred embodiment, the zeolite powder can be electrostatically charged by any electrostatic charging system, such as an electrostatic spray gun, for example.

Perfume

As used herein the term "perfume" is used to indicate any odoriferous material which is subsequently released into the aqueous bath and/or onto fabrics contacted therewith. The perfume will most often be liquid at ambient temperatures. A wide variety of chemicals are known for perfume uses, including materials such as aldehydes, ketones and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g., rose extract, violet extract, and lilac. The perfumes can also be formulated to provide desirable fruity odors, e.g., lime, lemon, and orange. Any chemically compatible material which exudes a pleasant or otherwise desirable odor can be used in the perfumed compositions herein.

Perfumes also include pro-fragrances such as acetal pro-fragrances, ketal pro-fragrances, ester pro-fragrances (e.g., digeranyl succinate), hydrolyzable inorganic-organic pro-fragrances, and mixtures thereof. These pro-fragrances may release the perfume material as a result of simple hydrolysis, or may be pH-change-triggered pro-fragrances (e.g., pH drop) or may be enzymatically releasable pro-fragrances.

In the preferred embodiment, the amount of perfume adsorbed on the carrier material, such as zeolite for example, is preferably in the range of 0.1% to 50% by weight, more preferably in the range of 0.5% to 25% by weight, and most preferably in the range of 1% to 15% by weight of zeolite powder.

Electrostatic Charging and Delivery System

The perfume loaded carrier material is uniformly distributed on the surface of the detergent tablets preferably by means of an electrostatic charging and delivery system. U.S. Pat. No. 4,780,331, Cobbs, Jr. et al., issued Oct. 25, 1988, incorporated herein, describes a particular method and apparatus for charging powder particles by electrostatic induction. Generally, the electrostatic charging system contains electrodes which ionize the air surrounding them. The perfume loaded carrier material is preferably in a finely divided powder form. The finely divided powder is passed by these electrodes and acquires the ionic charges. The powder is then distributed in the area of the detergent tablets. Because of the electrostatic charges, the powder is attracted to and uniformly distributed on the surfaces of the detergent tablets. It is not necessary to charge the detergent tablets. The detergent tablets must be grounded. As a practical matter, the detergent tablets are not individually grounded but the object which contains them, preferably a conveyor belt, should be grounded. After the charged powder application, there is no need for a curing or fusion step to ensure long-term adhesion of the powder on the tablet.

The preferred electrostatic system for use herein is an electrostatic powder spray gun. An electrostatic powder spray gun is described in U.S. Pat. No. 4,380,320, Hollstein et al., issued Apr. 19, 1983, incorporated herein. This step preferably comprises charging the finely divided powder in an electrostatic powder spray gun and then spraying the charged finely divided powder from the gun onto the detergent tablets.

The most preferred electrostatic powder spray gun for use herein has three parts: a gravity feed hopper, a control console, and the gun itself. The finely divided powder is fed into the gravity feed hopper. The control console has controls for regulating flow rate, fluidizing rate, atomizing rate and voltage level. The type of powder used generally controls which rate settings give the best results. The finely divided powder is channeled from the gravity feed hopper into the central passageway of the gun. Pressurized gas forces the powder through the passageway, where the powder acquires an electrostatic charge and, when a trigger on the gun is pressed by an operator, the charged powder is emitted from the gun in a conical spray pattern.

It is preferred that multiple electrostatic powder spray guns be mounted above and below a conveyor belt having perforations or openings therein. The nozzle of the gun is preferably pointed directly at the tablets from both sides of the conveyor belt. The detergent tablets are placed on the conveyor belt randomly, when the cloud of charged powder particles is emitted from the gun. The charged powder particles are attracted to the detergent tablet surface and are uniformly distributed on the surfaces of the tablets.

Any other method for maintaining the tablets in the area of the charged powder particles can be used; for example, by placing the detergent tablets within a fluidized bed chamber. In a fluidized bed chamber, the finely divided particles are charged by ionized air which passes through a perforated plate at the base of the chamber and the charged particles are uniformly deposited on the detergent tablets.

EXAMPLE A

In each of the following Samples 1–4, detergent tablets having an electrically conductive surface, such electrically conductive surface being preferably in the form of a coating, were formed according to the following composition:

TABLE A.1

| Tablet Ingredients | % by weight |
|---|---|
| $C_{12-16}$ linear alkylbenzene sulfonate | 7.98 |
| $C_{14-15}$ alkyl sulfate/$C_{14-15}$ alkyl ethoxy sulfate | 7.54 |
| $C_{12-13}$ alkyl ethoxylate | 1.60 |
| polyacrylate (MW = 4500) | 2.18 |
| polyethylene glycol (MW = 4000) | 0.87 |
| sodium sulfate | 7.62 |
| aluminosilicate | 19.30 |
| sodium carbonate | 15.23 |
| protease enzyme | 0.29 |
| sodium perborate monohydrate | 1.89 |
| lipase enzyme | 0.15 |
| cellulase enzyme | 0.07 |
| NOBS extrudate | 4.35 |
| citric acid monohydrate | 2.04 |

TABLE A.1-continued

| Tablet Ingredients | % by weight |
|---|---|
| sodium bicarbonate | 2.49 |
| sodium acetate | 13.60 |
| free water | 1.45 |
| other minor ingredients (perfume etc.) | 2.03 |
| The electrically conductive tablet coating had the following composition: | |
| dodecanedioc acid | 8.39 |
| carboxymethyl cellulose | 0.93 |

The tablets were formed by compressing the tablet ingredients in a cylindrical die having a diameter of 55 mm using a laboratory press having a trade name Carver Model 3912, to form a tablet having a height of 20 mm. The formed tablets were then coated with the electrically conductive coating by dipping the tablet into a molten bath of the coating for about 3 seconds. The molten coating bath was maintained at a temperature of about 145 degrees centigrade.

The term "NOBS extrudate" as used herein, is an acronym for the chemical sodium nonanoyloxybenzene sulfonate, commercially available from Eastman Chemicals, Inc. The carboxymethyl cellulose used in the above example is commercially available from Metsa-Serla and sold under the trade name, Nymcel ZSB-16.

For the samples that appear hereinunder, the perfume loaded zeolite (PLZ) powder was prepared by mixing zeolite A powder with detergent perfume in a Cuisinart food mixer. Two different formulations of the PLZ powder were prepared as shown in Table A.2 hereunder:

TABLE A.2

| | Zeolite (weight %) | Perfume (weight %) |
|---|---|---|
| PLZ1 | 99.5 | 0.5 |
| PLZ2 | 94.0 | 6.0 |

The above PLZ powders were applied on the coated detergent tablets using a brush, to achieve different amounts of PLZ deposits on the detergent, as shown hereunder. The tablet odor was then assessed by a trained perfumer to determine a Neat Product Odor (NPO) grade for each tablet. The NPO was reported in a scale of 0 to 10, to reflect the relative impact of the base tablet odor. A higher grade represents a better odor result. The results were as shown in Table A.3 hereunder.

TABLE A.3

| | Grams of PLZ1 added | Grams of PLZ2 added | Neat Product Odor grade |
|---|---|---|---|
| Sample 1 | — | — | 6.5 |
| Sample 2 | 0.5 | — | 7.0 |
| Sample 3 | — | 0.5 | 8.0 |
| Sample 4 | — | 1.0 | 9.0 |

As can be seen above, samples 2, 3 and 4 exhibited unexpected improvement in NPO and also possessed excellent appearance and other physical properties.

EXAMPLE B

In each of the following Samples 5–8, detergent tablets having an electrically conductive coating were formed according to the same composition and in the same manner as set forth in Example A above. For the samples that appear hereinunder, the perfume loaded zeolite (PLZ) powder was prepared by mixing zeolite A powder with detergent perfume in a Cuisinart food mixer in a weight ratio of 99.5:0.5, zeolite:perfume.

The above perfume loaded zeolite powder was then electrostatically deposited on the detergent surface. The electrostatic charging and delivery system was a manual powder system, MPS-D, from American Industrial Co. The spraying gun s fixed at measured distance from the tablet, and the powder was sprayed in measured time intervals. A voltage of 100 kV was applied to the spraying gun for charging the perfume loaded zeolite powder. The tablet was weighted before and after each spraying to measure the amount of powder adhered to the tablet The results are shown in Table B.1.

TABLE B.1

| Sample | Voltage kV | Spraying Time sec | Gun to Tablet distance cm | Adhered powder g |
|---|---|---|---|---|
| 5 | 100 | 10 | 20 | 0.07 |
| 6 | 100 | 5 | 15 | 0.178 |

In comparison, samples 7–8, which represent detergent tablets that were sprayed with non-electrostatically charged powder, exhibited a much lesser amount of perfume loaded zeolite powder deposited thereon, as shown in Table B.2 below:

TABLE B.2

| Sample | Voltage kV | Spraying Time sec | Gun to Tablet distance cm | Adhered powder g |
|---|---|---|---|---|
| 3 | 0 | 10 | 20 | 0.002 |
| 4 | 0 | 5 | 15 | 0.015 |

As can been by comparing the results in Tables B.1 and B.2, the amount of charged powder adhered to tablets was unexpectedly, approximately ten times greater than the amount of non-charged powder adhered to tablets.

Accordingly, having thus described the invention in detail, it will be obvious to those skilled in the art that various changes may be made without departing from the scope of the invention and the invention is not to be considered limited to what is described in the specification.

What is claimed is:

1. A process for producing a non-particulate detergent product having a perfume loaded carrier material coating, comprising the steps of:

(a) providing a non-particulate detergent composition having an electrically conductive surface;

(b) grounding said electrically conductive surface of said non-particulate detergent composition;

(c) providing an electrostatically chargeable carrier material having a perfume adsorbed therein;

(d) coating said electrostatically chargeable carrier material onto said electrically conductive surface of said non-particulate detergent composition by means of applying an electrostatic charge with an electrostatic charging and delivery system, such that said electrostatically charged carrier material is adhered to said electrically conductive surface of said detergent composition, even after dissipation of said electrostatic charge.

2. The process of claim 1 wherein said electrically conductive surface is formed of a coating comprising a material which is insoluble in water at 25 degrees C.

3. The process of claim 1 wherein said electrically conductive surface is formed of a coating comprising a water-insoluble material having a melting point in the range of about 40 degrees C. to about 180 degrees C.

4. The process of claim 1 wherein said electrically conductive surface is formed of a coating selected from the group consisting of $C_{12}$–$C_{22}$ fatty acids, adipic acid, $C_8$–$C_{13}$ dicarboxylic acids, or mixtures thereof.

5. The process of claim 1 wherein said electrically conductive surface is formed of a coating selected from the group consisting of C12–C22 fatty alcohols.

6. The process of claim 1 wherein said electrostatically chargeable carrier material is in the form of porous carrier particles.

7. The process of claim 6 wherein said porous carrier particles are selected from the group consisting of amorphous silicates, crystalline nonlayered silicates, layered silicates, calcium carbonates, calcium/sodium carbonate double salts, sodium carbonates, clays, zeolites, sodalites, alkali metal phosphates, macroporous zeolites, chitin microbeads, carboxyalkylcelluloses, carboxyalkylstarches, cyclodextrins, porous starches and mixtures thereof.

8. The process of claim 6 wherein said porous carrier particles are selected from the group consisting of Zeolite A, Zeolite X, Zeolite Y, Zeolite P, Zeolite MAP and mixtures thereof.

9. The process of claim 1 wherein said electrostatic charging and delivery system is an electrostatic powder spray gun.

10. The process of claim 9 wherein said electrostatically chargeable carrier material is provided to said spray gun in the form of finely divided particles which are electrostatically charged by said spray gun and then sprayed onto said electrically conductive surface of said non-particulate detergent composition.

11. The process of claim 1 wherein said electrostatically chargeable carrier material is in the form of particles having a mean diameter less than 25 microns.

12. The process of claim 1 wherein said electrostatic charging and delivery system is an electrostatic fluidized bed chamber.

13. The process of claim 12 wherein said perfume loaded carrier material is in the form of finely divided particles suspended in said fluidized bed chamber and electrostatically charged by ionized air passing through said chamber, and said non-particulate detergent composition is placed in said bed chamber and in contact with a grounding source.

* * * * *

UNITED STATES PATENT AND TRADEMARK OFFICE

CERTIFICATE OF CORRECTION

PATENT NO. : 6,498,135 B1 
DATED : December 24, 2002
INVENTOR(S) : Adrian John Waynforth Angell et al.

It is certified that error appears in the above-identified patent and that said Letters Patent is hereby corrected as shown below:

Title page,
Item [63], Related U.S. Application Data, after the term "Provisional application No. 60/080,782, filed on Apr. 6, 1998," please add the following: -- & Provisional Application no. 60/080,835, filed on April 6, 1998 --

Signed and Sealed this

Seventeenth Day of June, 2003

JAMES E. ROGAN
*Director of the United States Patent and Trademark Office*